US006439858B1

(12) United States Patent
Kume et al.

(10) Patent No.: US 6,439,858 B1
(45) Date of Patent: Aug. 27, 2002

(54) CONTROL VALVE FOR VARIABLE CAPACITY COMPRESSORS

(75) Inventors: Yoshiyuki Kume; Masayuki Imai, both of Tokyo (JP)

(73) Assignee: Fujikoki Corporation, Tokyo (JP)

( * ) Notice: Subject to any disclaimer, the term of this patent is extended or adjusted under 35 U.S.C. 154(b) by 0 days.

(21) Appl. No.: 09/696,069

(22) Filed: Oct. 25, 2000

(30) Foreign Application Priority Data

Nov. 30, 1999 (JP) ..... 11-339826

(51) Int. Cl.[7] ..... F04B 1/26
(52) U.S. Cl. ..... 417/222.2; 417/270
(58) Field of Search ..... 417/222.2, 270, 417/295

(56) References Cited

U.S. PATENT DOCUMENTS 4,862,700 A * 9/1989 Suzuki ..... 62/115
4,875,832 A * 10/1989 Suzuki et al. ..... 417/222
5,145,326 A * 9/1992 Kimura et al. ..... 417/222.2
5,865,604 A * 2/1999 Kawaguchi et al. ..... 417/222.2
5,971,716 A * 10/1999 Ota et al. ..... 417/222.2
6,149,398 A * 11/2000 Fukanuma et al. ..... 417/222.2
6,234,763 B1 * 5/2001 Ota et al. ..... 417/222.2

FOREIGN PATENT DOCUMENTS

JP 0357782 A1 * 3/1990

* cited by examiner

*Primary Examiner*—Charles G. Freay
*Assistant Examiner*—Han L. Liu
(74) *Attorney, Agent, or Firm*—Baker Botts L.L.P.

(57) ABSTRACT

A control valve for a variable capacity compressor, which comprises a valve housing having a valve port formed between an inlet port and an outlet port, a valve disposed inside the valve housing for controlling the flow rate through the adjustment of opening degree of the valve port, a pressure sensitive bellows for actuating the opening or closing of the valve, and a solenoid magnetization means, wherein the pressure sensitive bellows is incorporated into the plunger of the solenoid magnetization means.

7 Claims, 5 Drawing Sheets

CONTROL VALVE FOR VARIABLE CAPACITY COMPRESSORS

BACKGROUND OF THE INVENTION

The present invention relates to a control valve for a variable capacity compressor, which is adapted for use in controlling the capacity of variable capacity compressor to be employed in air conditioners for vehicles, etc., and in particular to an electromagnetic controlling means-attached control valve for a variable capacity compressor, which is provided with a pressure sensitive bellows and a solenoid magnetizing means.

As a variable capacity compressor to be employed in air conditioners for vehicles, etc., there is known a wobble plate type variable capacity compressor which is designed to change the discharge capacity thereof by making the inclination angle of the wobble plate variable, thereby controlling the pressure of crankcase of the wobble plate type variable capacity compressor. Namely, this control valve for a variable capacity compressor functions as a flow rate controlling valve for controlling the pressure of crankcase by introducing a discharge pressure into the crankcase of the wobble plate type variable capacity compressor.

As one example of a control valve for a variable capacity compressor, there is known, as shown in Japanese Patent Unexamined Publication (Kokai) H9-268974, an electromagnetic controlling means-attached control valve for a variable capacity compressor, which comprises a valve housing having a valve port formed between an inlet port and an outlet port, a valve disposed inside the valve housing for controlling the flow rate through the adjustment of opening degree of the valve port, a pressure sensitive bellows for actuating the opening or closing of the valve, and a solenoid magnetization means.

This electromagnetic controlling means-attached control valve for a variable capacity compressor is basically designed such that through a detection of an inlet pressure of the compressor, the pressure sensitive bellows is extended or contracted to actuate the valve so as to adjust the opening degree of the valve port, thereby controlling the pressure of crankcase in accordance with the magnitude of inlet pressure. Therefore, when a cooling load is relatively large, the valve is caused to deviate in the direction to close the valve through the magnetization of the solenoid magnetizing means, thereby decreasing the opening degree of the valve port and hence, making the pressure of crankcase close to the inlet pressure, thus controlling the variable capacity compressor to increase the discharge capacity thereof.

Although the aforementioned electromagnetic controlling means-attached control valve for a variable capacity compressor is capable of achieving objects expected, the pressure sensitive bellows and solenoid magnetization means thereof are arranged in a row along the direction of opening or closing the valve, thus raising a problem that the size of the compressor becomes bulky, i.e. it is difficult to make the compressor compact in configuration. The miniaturization of the control valve for a variable capacity compressor is very important requisite as it is mounted on a vehicle.

Further, the conventional electromagnetic controlling means-attached control valve for a variable capacity compressor is constructed such that a solenoid assembly (electromagnetic coil portion) constituting an electric component of the solenoid magnetization means is mounted on the valve housing by means of caulking, i.e. the solenoid assembly is not enabled to be reattached afterward to the valve housing. Therefore, the conventional electromagnetic controlling means-attached control valve is poor in operability in assembling the solenoid assembly, i.e. it is impossible to easily perform the exchange of the solenoid assembly as demanded for meeting the property of the control valve, or for the purpose of maintenance.

BRIEF SUMMARY OF THE INVENTION

The present invention has been made under the circumstances mentioned above, and therefore an object of the present invention is to provide an electromagnetic controlling means-attached control valve for a variable capacity compressor, which is suited for miniaturizing the valve, for enabling the solenoid assembly to be reattached afterward to the valve housing, and for the attachment or exchange of the solenoid assembly.

With a view to achieve the aforementioned object, the present invention provides a control valve for a variable capacity compressor, which comprises a valve housing having a valve port formed between an inlet port and an outlet port, a valve disposed inside the valve housing for controlling the flow rate through the adjustment of opening degree of the valve port, a pressure sensitive bellows for actuating the opening or closing of the valve, and a solenoid magnetization means; which is featured in that the solenoid magnetization means comprises a solenoid assembly, a fixed suction member, a plunger which is designed to be adsorbed onto the fixed suction member by the magnetization of solenoid assembly, and a plunger spring for urging the plunger to move in a direction away from the fixed suction member; that the plunger is provided therein with an inner cylindrical portion housing therein the pressure sensitive bellows and connected at the distal end portion thereof with the valve, the pressure sensitive bellows being housed inside the inner cylindrical portion; and that the pressure sensitive bellows is fixedly connected through one end member thereof with a distal end of the plunger and through the other end member thereof with the fixed suction member.

According to a preferable embodiment of the control valve for a variable capacity compressor of the present invention, the control valve further comprises an adjuster plug screwed to the fixed suction member, and said other end member of the pressure sensitive bellows is connected via a connecting rod with the adjuster plug, thereby enabling to adjust the initial state of the pressure sensitive bellows by means of the adjuster plug.

According to another preferable embodiment of the control valve for a variable capacity compressor of the present invention, a valve-closing spring-for urging the valve in the direction to close the valve is interposed between the valve and an adjusting spring retainer screwed to the valve housing thereby enabling to adjust the set load of the valve-closing spring by means of the adjusting spring retainer, or a valve-closing spring for urging the valve in the direction to close the valve is interposed between the valve and a press-fitted spring retainer press-fittingly fixed to the valve housing, the fixed position thereof being made adjustable, thereby enabling to adjust the set load of the valve-closing spring by means of the press-fitted spring retainer.

According to a further preferable embodiment of the control valve for a variable capacity compressor of the present invention, the valve is constituted by a spool valve or a ball valve.

According to a further preferable embodiment of the control valve for a variable capacity compressor of the present invention, it is featured in that it further comprises a plunger tube fixedly attached to the solenoid-mounting portion of the valve housing and housing therein the plunger which is made slidable in the axial direction thereof, that the fixed suction member is coaxially fixed to the distal end of the plunger tube, and that the cylindrical solenoid assembly is removably mounted on the outer wall of the plunger tube and of the fixed suction member.

According to the control valve for a variable capacity compressor of the present invention which is constructed as mentioned above, the pressure sensitive bellows is housed in an inner cylindrical portion of the plunger, i.e. the pressure sensitive bellows is housed inside the plunger, thereby making it possible to miniaturize the control valve.

Further, according to the control valve for a variable capacity compressor of the present invention, the initial state of the pressure sensitive bellows is made adjustable by means of the adjuster plug, and the set load of the valve-closing spring is made adjustable by means of the adjusting spring retainer or by means of the press-fitted spring retainer.

Moreover, according to the control valve for a variable capacity compressor of the present invention, since the cylindrical solenoid assembly is removably mounted on the outer wall of the plunger tube and of the fixed suction member, the solenoid assembly can be reattached afterward to the valve housing, thereby making it possible to easily perform the attachment or exchange of the solenoid assembly.

DETAILED DESCRIPTION OF THE INVENTION

Various embodiments of a control valve for a variable capacity compressor according to the present invention will be explained with reference to the drawings.

Figure 1:
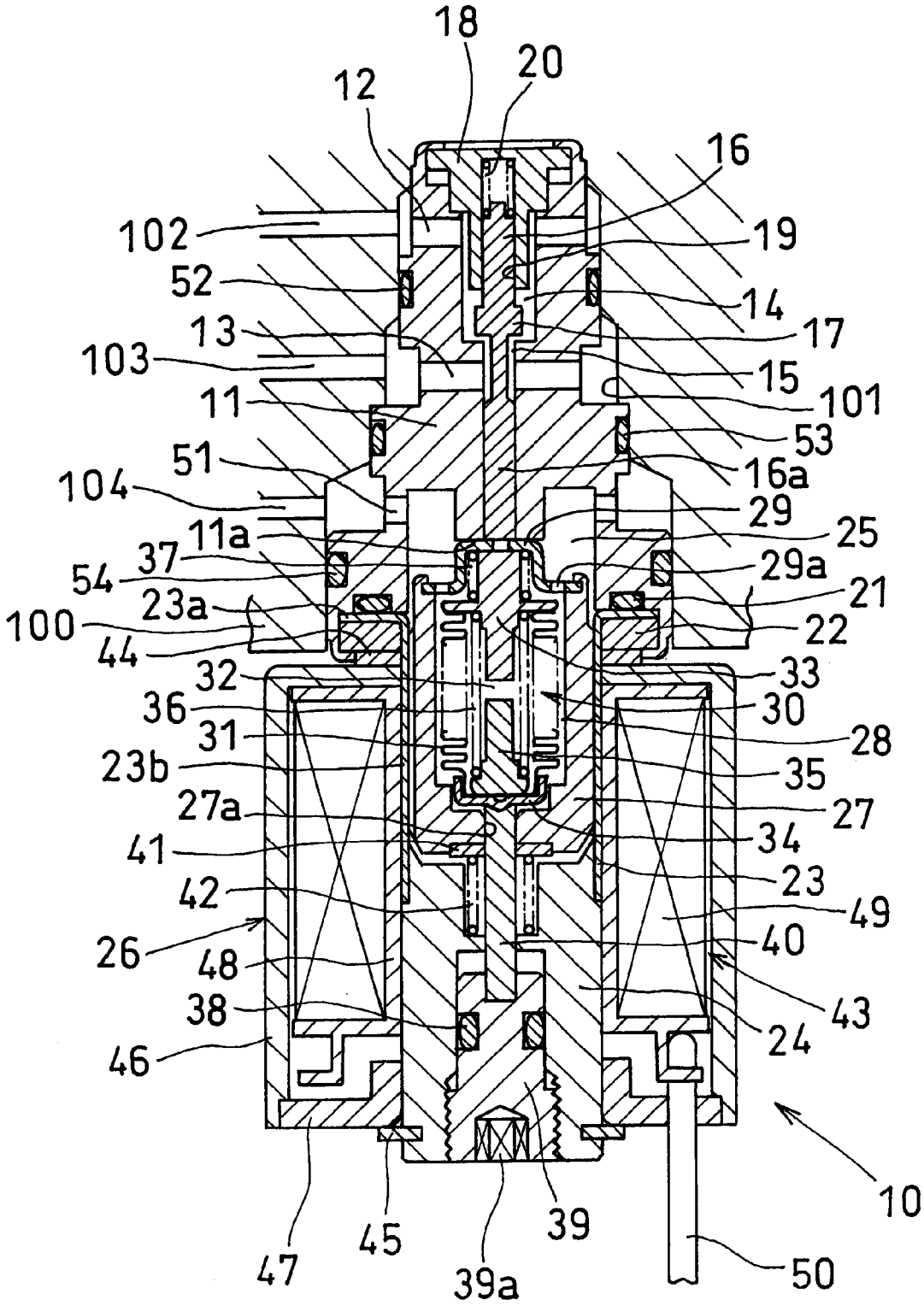
FIG. 1 is a longitudinal sectional view of a control valve for a variable capacity compressor according to a first embodiment of the present invention.

FIG. 1 shows a longitudinal sectional view of a control valve for a variable capacity compressor according to a first embodiment of the present invention. In FIG. 1, the control valve for a variable capacity compressor is integrally identified by a reference numeral 10. The control valve 10 comprises a valve housing 11 which is constituted by an inlet port 12, an outlet port 13, a valve chamber 14 formed between the inlet port 12 and the outlet port 13, and a valve port 15.

Inside this valve chamber 14, there is disposed a spool valve 16 which is made movable in the elevational direction as viewed in FIG. 1 (in the axial direction of the valve). This spool valve 16 is provided with a large diametrical valve land portion 17, which is enabled to move close to or away from the valve port 15, thereby quantitatively increasing or decreasing the opening degree of the valve port 15.

A valve guide member 18 is fixed to one end (the upper end) of the valve housing by means of caulking and provided with a guide hole 19 for guiding the movement in the axial direction of the spool valve 16. A valve-closing spring 20 for urging the spool valve 16 to move downward as viewed in FIG. 1 (i.e. in the valve-closing direction) is interposed between the bottom of the guide hole 19 and the upper end of the spool valve 16.

A mounting flange 23*a* formed at one end of the plunger tube 23 is fixed via an O-ring 21 and a spacer 22 to the other end (the lower portion) of the valve housing 11 by means of caulking so as to enable the cylindrical plunger tube 23 to be fixed coaxial with the spool valve 16 to the valve housing 11. To the distal end (the other end) of plunger tube 23 is fixed coaxially a fixed suction member 24 of the solenoid magnetization means 26 by means of welding, for instance. This fixed suction member 24 is constituted by a circular cross-sectional member having the same outer diameter as the outer diameter of the plunger tube 23, and the outer wall surface of the fixed suction member 24 is made coaxial and flush with the outer wall surface of the plunger tube 23.

A plunger housing/pressure sensitive chamber 25 of closed structure is formed on the other side of the valve housing 11, the chamber 25 being defined by the members including the other end of the valve housing 11, the cylindrical portion 23*b* of the plunger tube 23 and the fixed suction member 24.

Inside this plunger housing/pressure sensitive chamber 25, there is disposed a plunger 27 of the solenoid magnetization means 26 which is made movable in the elevational direction as viewed in FIG. 1 (in the axial direction of the valve). This plunger 27 is engaged slidably with the cylindrical portion 23*b* of the plunger tube 23. In other words, the plunger 27 is housed inside the cylindrical portion 23*b* of the plunger tube 23 with the plunger 27 being made slidable in the axial direction thereof.

This plunger 27 is formed into a cup-like configuration forming therein an inner cylindrical portion 28 for housing the pressure sensitive bellows (a pressure sensitive bellows housing inner cylinder), and contacted via an end member 29 fixed to the distal end (the upper end) thereof with the stem portion 16*a* of the spool valve 16. This spool valve 16 is always urged by the resilient force of a valve-closing spring 20, so that the distal end of the stem portion 16*a* is always pressed onto the end member 29. Therefore, in response to the descending movement of the plunger 27 and the end member 29, the spool valve 16 is caused to move due to the resilient force of the valve-closing spring 20 in the direction to close the valve. On the other hand, when the plunger 27 and the end member 29 are moved upward, the spool valve 16 is caused to move against the resilient force of the valve-closing spring 20 in the direction to open the valve. By the way, as shown in FIG. 1, a state where the end member 29 is contacted with the end face 11*a* of the valve housing 11 is the maximum open state of valve.

A pressure sensitive bellows 30 is disposed inside the pressure sensitive bellows housing inner cylinder 28. This pressure sensitive bellows 30 is constituted by a metallic main body 31, a pair of end members 33 (a distal end of the plunger 27) and 34 (an end of the fixed suction member 24) functioning also as a stopper and fixed respectively to both ends of the main body 31 so as to define a vacuum chamber 32 within the main body, a stopper member 35 fixed to the end member 34, and an inner spring 36 interposed between the end members 33 and 34. This pressure sensitive bellows 30 is designed to be expanded or contracted in the axial direction of the spool valve 16 in response to an external pressure, i.e. a difference in pressure between the pressure of the pressure sensitive bellows housing inner cylinder 28 and the pressure inside the vacuum chamber 32.

The end member 33 constituting one of the end members of the pressure sensitive bellows 30 is engaged with the end member 29 of the plunger 27, and a compression coil spring 37 is interposed between these end members 33 and 29. The fixed suction member 24 is screw-engaged via an O-ring 38 with an adjust plug 39 so as to ensure an air-tight condition, the adjust plug 39 being fixedly connected with one end of a linking rod 40. this linking rod 40 is disposed to protrude through a through-hole 27*a* of the plunger 27 into the pressure sensitive bellows housing inner cylinder 28, the protruded end thereof being engaged with the end member 34 constituting the other one of the pressure sensitive bellows 30. In other words, this end member 34 of the pressure sensitive bellows 30 is connected through the linking rod 40 with the adjust plug 39.

This adjust plug 39 is provided with a hexagon wrench hole 39*a*, thereby enabling this adjust plug 39 to be adjusted of its engaging position relative to the fixed suction member 24 of the adjust plug 39 by making use of a hexagon wrench. Through the adjustment of the engaging position of this adjust plug 39 relative to the fixed suction member 24, the initial state of the pressure sensitive bellows 30 can be adjusted.

Further, the valve housing 11 is also provided with a working fluid pressure port 51 for introducing a working fluid pressure into the plunger housing/pressure sensitive chamber 25, while the end member 29 is provided with a through-hole 29*a* for introducing a working fluid pressure into the pressure sensitive bellows housing inner cylinder 28.

Between a seat plate 41 attached to the plunger 27 and the fixed suction member 24, there is interposed a plunger spring 42 for urging the plunger 27 to move away from the fixed suction member 24.

On the outer wall of the plunger tube 23 and of the fixed suction member 24, there is mounted a cylindrical solenoid assembly 43 of the solenoid magnetization means 26 in such a manner that the cylindrical solenoid assembly 43 is removably engaged with the outer wall of the plunger tube 23 and of the fixed suction member 24 and fixed in place by means of a spacer 44 and a C-ring 45, the spacer 44 being inserted into a space between the top surface of the cylindrical solenoid assembly 43 and the valve housing 11.

This cylindrical solenoid assembly 43 is constituted by a cup-shaped solenoid case 46, a ring-shaped end cover 47 fixed to the open end of the solenoid case 46, a coil bobbin 48 arranged inside the solenoid case 46, a winding 49 wound around the coil bobbin 48, and a wiring 50. This cylindrical solenoid assembly 43 is designed to be magnetized as an electric current is passed to the winding 49, thereby enabling the plunger 24 to be moved to contacted with or approach to the fixed suction member 24 against the resilient force of the plunger spring 42.

As shown in FIG. 1, the control valve 10 for a variable capacity compressor is constructed such that the valve housing 11 is fitted in a valve mounting hole 101 formed in the case 100 of the variable capacity compressor, and that a plurality of O-rings 52, 53 and 54 are mounted so as to air-tightly separate each of the ports 12, 13 and 51 of the valve housing 11, respectively. As the control valve 10 is attached to the case 100, the inlet port 12 is allowed to communicate with a discharge pressure passageway 102, the outlet port 13 is allowed to communicate with a crankcase passageway 103, and the working fluid pressure port 51 is allowed to communicated with an inlet pressure passageway 104. By the way, the solenoid assembly 43 is exposed out of the valve mounting hole 101 for the purpose of heat radiation.

Next, the operation of the control valve 10 for a variable capacity compressor, which is constructed as described above will be explained.

By way of the inlet pressure passageway 104, the inlet pressure of the variable capacity compressor is given to the working fluid pressure port 51, so that when the inlet pressure acting on the pressure sensitive bellows 30 disposed inside the pressure sensitive bellows housing inner cylinder 28 is raised, the pressure sensitive bellows 30 is caused to contract. As a result, the end member 29 and the plunger 27 are caused to move closer to the fixed suction member 24 against the resilient force of the plunger spring 42, and due to the movement of these end member 29 and plunger 27, the spool valve 16 is caused to move in the direction to close the valve due to the resilient force of the valve-closing spring 20, thereby reducing the opening degree of the valve port 15. As a result, the flow rate of the discharging fluid of the variable capacity compressor that can be introduced into the crankcase is decreased, thereby lowering the pressure of the crankcase and hence, increasing the discharge capacity of the variable capacity compressor.

Whereas, when the inlet pressure acting on the pressure sensitive bellows 30 disposed inside the pressure sensitive bellows housing inner cylinder 28 is lowered, the pressure sensitive bellows 30 is caused to expand. As a result, the end member 29 and the plunger 27 are caused to move away from the fixed suction member 24 due to the resilient force of the plunger spring 42, and due to the movement of these end member 29 and plunger 27, the spool valve 16 is caused to pushingly move in the direction to open the valve against the resilient force of the valve-closing spring 20, thereby enlarging the opening degree of the valve port 15. As a result, the flow rate of the discharging fluid of the variable capacity compressor that can be introduced into the crankcase is increased, thereby raising the pressure of the crankcase and hence, decreasing the discharge capacity of the variable capacity compressor.

When an electric current is passed to the winding 49 of the solenoid assembly 43, the winding 49 is magnetized, thereby enabling the plunger 24 and the end member 29 to be moved to contacted with or approach to the fixed suction member 24 against the resilient force of the plunger spring 42.

As a result, the spool valve 16 is caused to move in the direction to close the valve due to the resilient force of the valve-closing spring 20, thereby reducing the opening degree of the valve port 15. As a result, the flow rate of the discharging fluid of the variable capacity compressor that can be introduced into the crankcase is decreased, thereby lowering the pressure of the crankcase and hence, increasing the discharge capacity of the variable capacity compressor.

When an electric current to the winding 49 of the solenoid assembly 43 is stopped, the winding 49 is demagnetized, thereby enabling the plunger 24 and the end member 29 to be moved back to the initial positions thereof due to the resilient force of the plunger spring 42. As a result, the spool valve 16 is caused to move in the direction to open the valve, thereby enlarging the opening degree of the valve port 15. As a result, the flow rate of the discharging fluid to be introduced into the crankcase of the variable capacity compressor is increased, thereby raising the pressure of the crankcase and hence, decreasing the discharge capacity of the variable capacity compressor.

As explained above, according to the control valve 10 for a variable capacity compressor of this embodiment, since the pressure sensitive bellows 30 is housed in the pressure sensitive bellows housing inner cylinder 28 which is formed in the plunger 27, it is possible to minimize the dimension in the axial direction of the control valve and hence, to miniaturize the control valve. Further, the initial state of the pressure sensitive bellows 30 can be made adjustable by means of the adjuster plug 39, thereby enabling the controlling characteristics of the control valve 10 to be adjusted.

Furthermore, since the cylindrical solenoid assembly 43 is removably mounted on the outer wall of the plunger tube 23 and of the fixed suction member 24, the solenoid assembly 43 can be reattached afterward to the valve housing 11, thereby making it possible to easily perform the attachment or exchange of the solenoid assembly 43.

FIGS. 2, 3, 4 and 5 respectively illustrates a control valve for a variable capacity compressor according to a second, third, fourth and fifth embodiment of the present invention. By the way, the portions or members in FIGS. 2, 3, 4 and 5 which correspond to those shown in FIG. 1 will be represented by the same numerals thereby omitting the explanation thereof.

Figure 2:
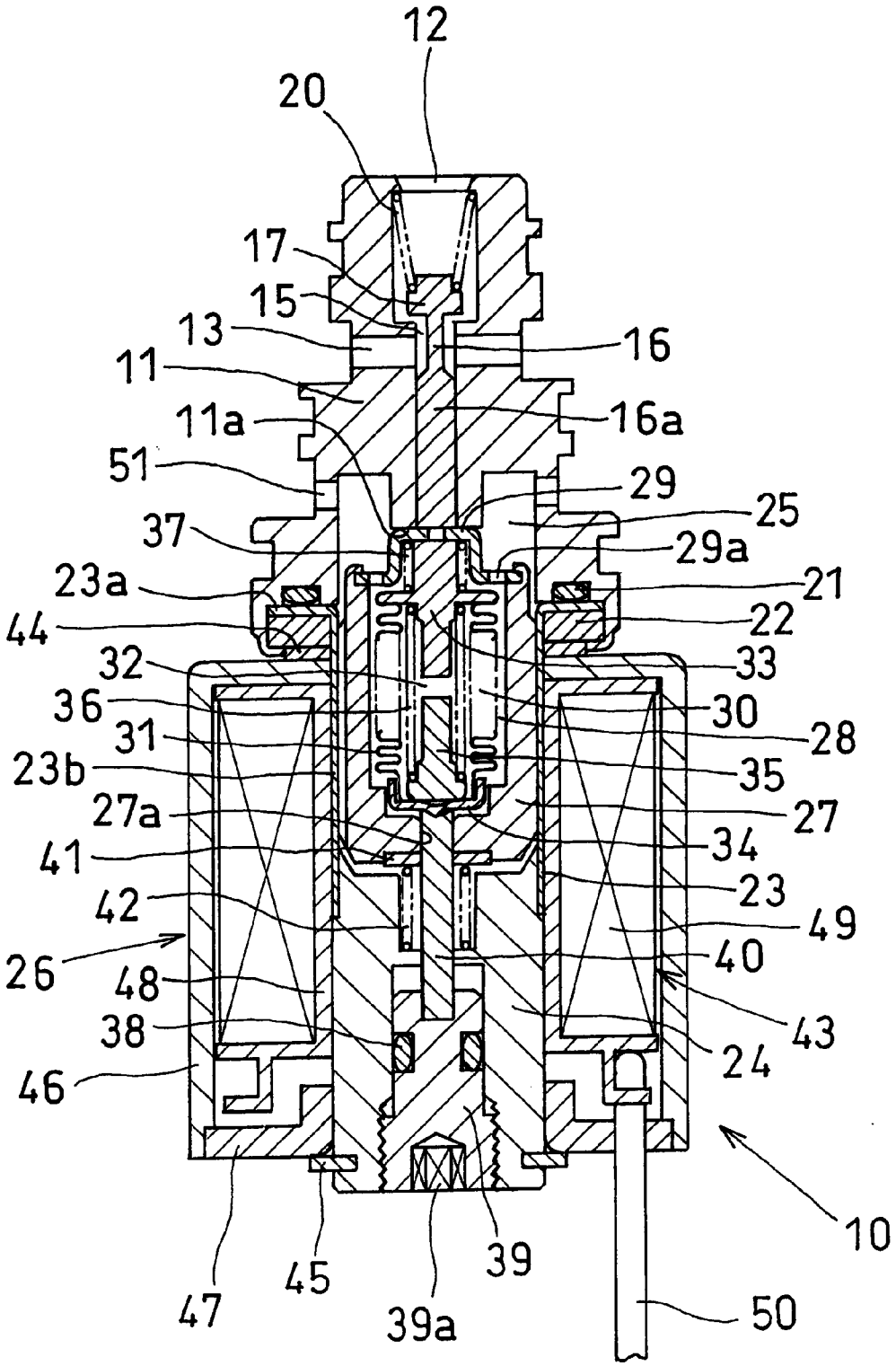
FIG. 2 is a longitudinal sectional view of a control valve for a variable capacity compressor according to a second embodiment of the present invention.

In the control valve 10 for a variable capacity compressor according to the second embodiment which is shown in FIG. 2, a cone-shaped compression coil spring is substituted for the cylindrical compression coil spring as a valve-closing spring 20, and this valve-closing spring 20 is attached to a portion between the spool valve 16 and the valve housing 11.

Figure 3:
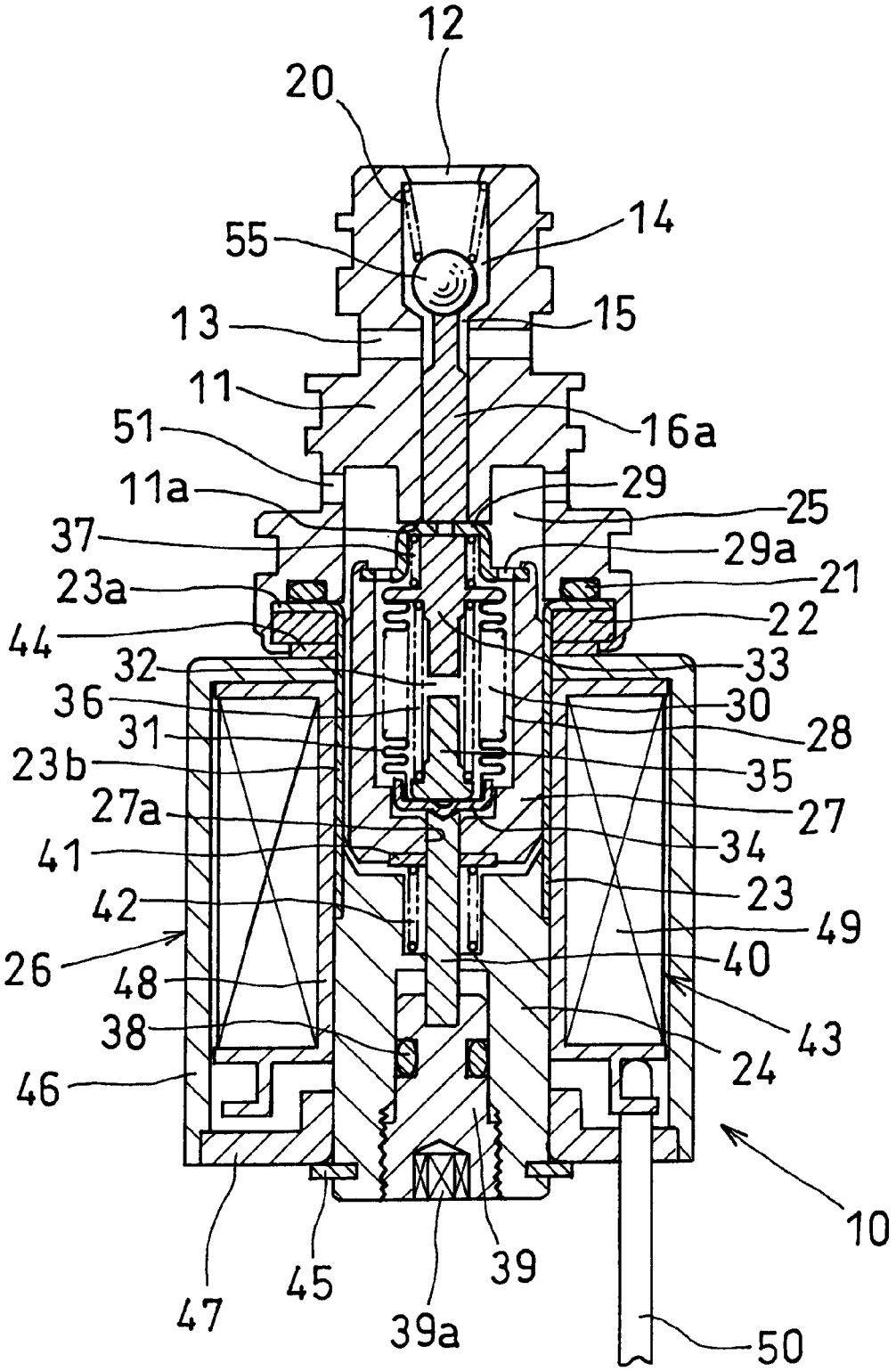
FIG. 3 is a longitudinal sectional view of a control valve for a variable capacity compressor according to a third embodiment of the present invention.

In the control valve 10 for a variable capacity compressor according to the third embodiment which is shown in FIG. 3, a ball valve 55 is employed as a valve for performing the adjustment of opening degree of the valve port 15, and the stem portion 16*a* is connected with the ball valve 55.

Figure 4:
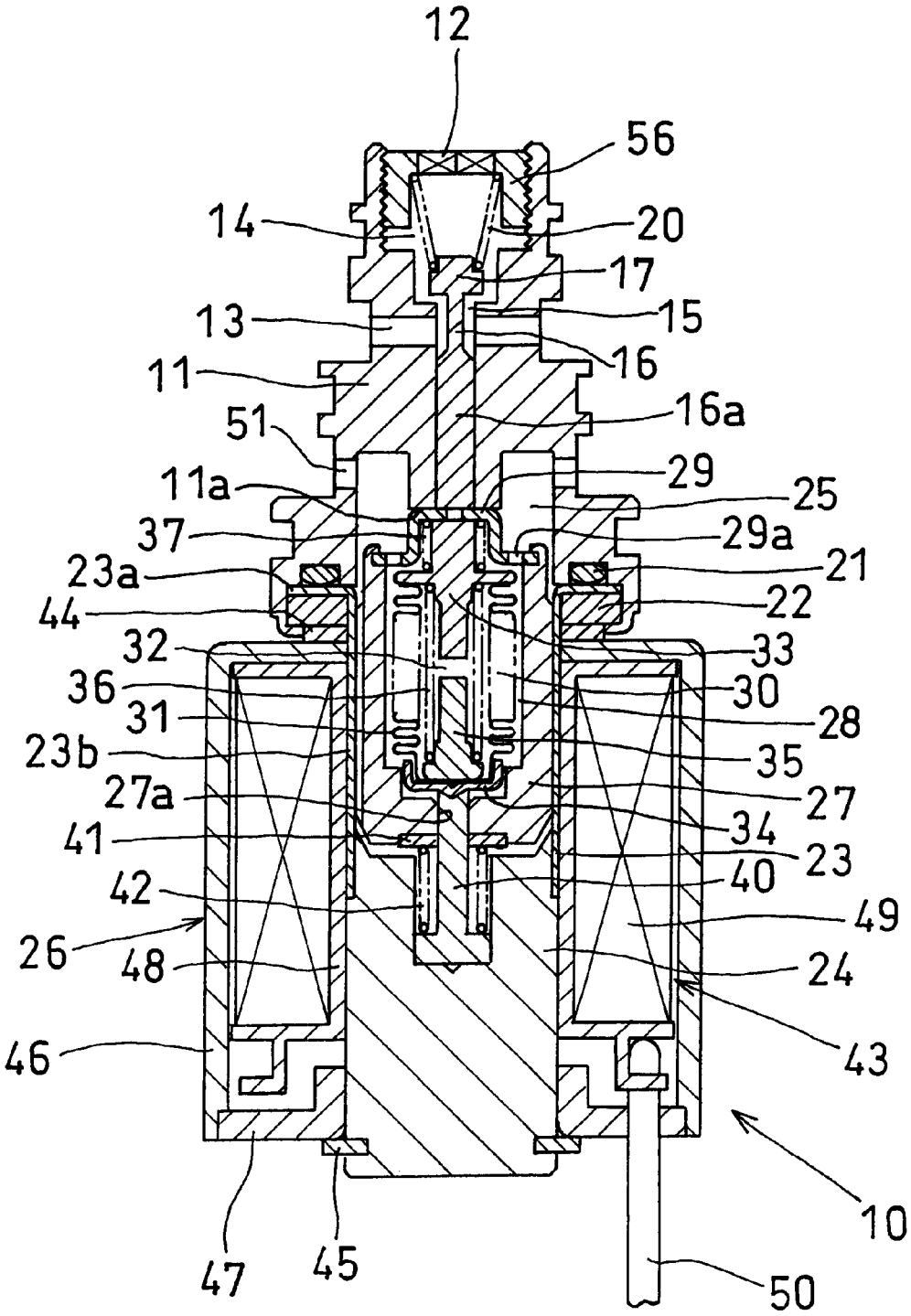
FIG. 4 is a longitudinal sectional view of a control valve for a variable capacity compressor according to a fourth embodiment of the present invention.

In the control valve 10 for a variable capacity compressor according to the fourth embodiment which is shown in FIG. 4, an adjust spring retainer 56 is screw-engaged with an upper portion of the valve housing 11, and the valve-closing spring 20 is attached to a portion between the adjust spring retainer 56 and the spool valve 16. Further, the adjust spring retainer 56 is provided with an inlet port 12 functioning as a hexagon wrench hole and formed passing through the adjust spring retainer 56.

According to this embodiment, by adjusting the screw engagement position of the adjust spring retainer 56 relative to the valve housing 11, the spring load to be set of the valve-closing spring 20 can be adjusted, thereby making it possible to adjust the controlling characteristics of the control valve 10 for a variable capacity compressor.

Figure 5:
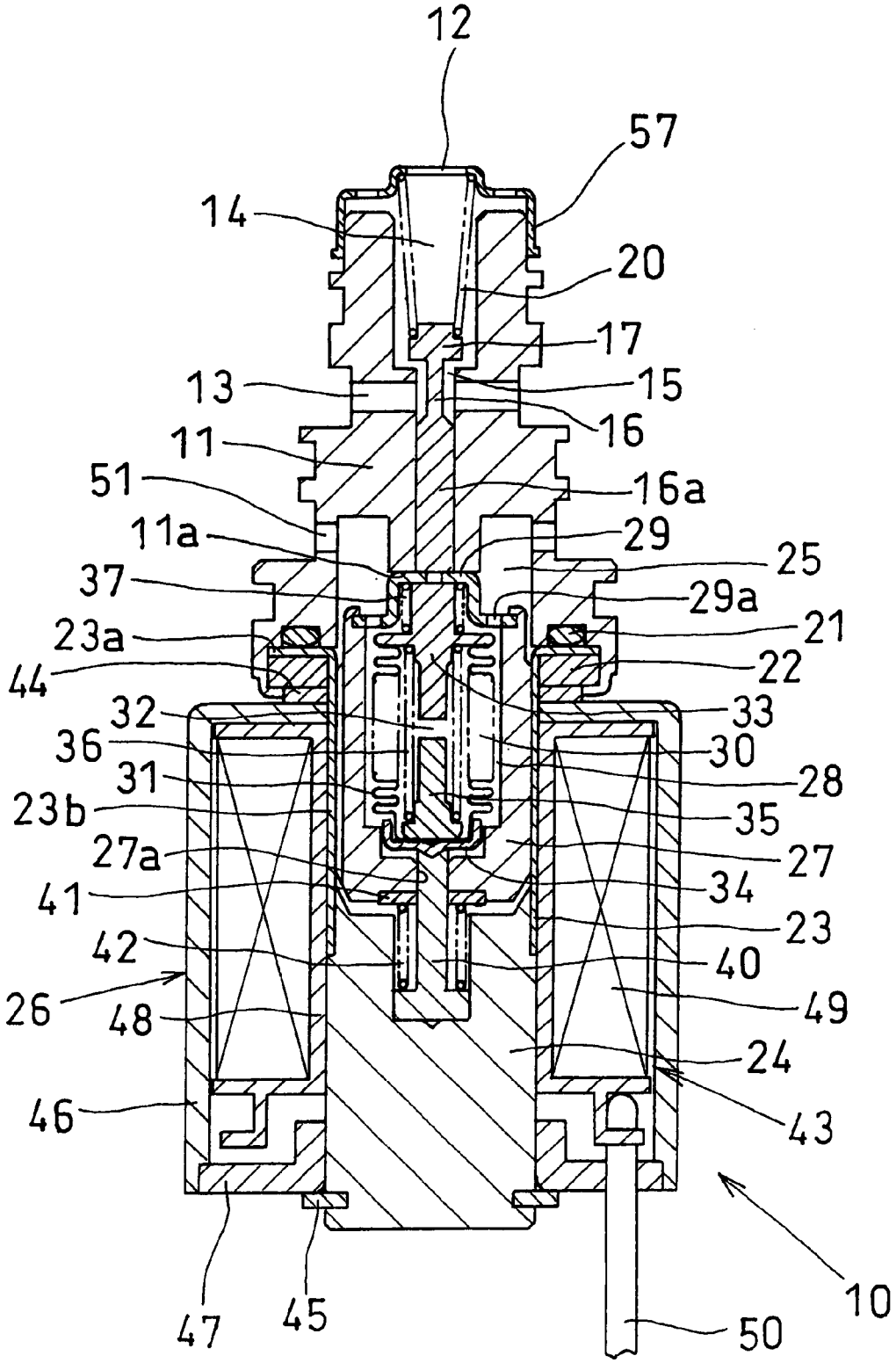
FIG. 5 is a longitudinal sectional view of a control valve for a variable capacity compressor according to a fifth embodiment of the present invention.

In the control valve 10 for a variable capacity compressor according to the fifth embodiment which is shown in FIG. 5, a press-fitted spring retainer 57 is press-fittingly fixed to the valve housing 11, the fixed position thereof being made adjustable, and the valve-closing spring 20 is attached to a portion between the press-fitted spring retainer 57 and the spool valve 16. Further, the press-fitted spring retainer 57 is provided with an inlet port 12 passing through the press-fitted spring retainer 57.

According to this embodiment, by adjusting the press-fitting position of the press-fitted spring retainer 57 relative to the valve housing 11, the spring load to be set of the valve-closing spring 20 can be adjusted, thereby making it possible to adjust the controlling characteristics of the control valve 10 for a variable capacity compressor.

By the way, the control valves 10 for a variable capacity compressor according to the second, third, fourth and fifth embodiment are constructed in the same manner as that of the first aforementioned embodiment except the aforementioned specific features, the same functions and effects as those of the first embodiment can be obtained.

As apparent from the above explanation, according to the control valve for a variable capacity compressor of the present invention, since the pressure sensitive bellows is housed in the pressure sensitive bellows housing inner cylinder which is formed in the plunger, it is possible to miniaturize the control valve.

Further, according to the control valve for a variable capacity compressor of the present invention, the initial state of the pressure sensitive bellows is made adjustable by means of the adjuster plug, and the set load of the valve-closing spring is made adjustable by means of the adjusting spring retainer or by means of the press-fitted spring retainer, so that the controlling characteristics of the control valve for a variable capacity compressor can be variously set through these adjustments.

Moreover, according to the control valve for a variable capacity compressor of the present invention, since the cylindrical solenoid assembly is removably mounted on the outer wall of the plunger tube and of the fixed suction member, the solenoid assembly can be reattached afterward to the valve housing, thereby making it possible to easily perform the attachment or exchange of the solenoid assembly, thus improving the workability of the control valve.

What is claimed is:

1. A control valve for a variable capacity compressor, comprising:

a valve housing having a valve port formed between an inlet port and an outlet port:

a valve member disposed inside the valve housing for movement relative to the valve port to control the flow rate through the adjustment of the opening degree of the valve port;

a solenoid magnetization unit coupled to the valve housing, the solenoid magnetization unit including a cylindrical solenoid assembly having a central axis, and having one axial end located proximate to the valve housing and the other axial end located distally from the valve housing, a fixed suction member located at the distal end of the solenoid assembly, a plunger, having an inner cylindrical portion, disposed within said solenoid assembly for movement axially thereof, the plunger having one axial end proximate to the valve housing and the other axial end distal from the valve housing, the proximate end of the plunger being operatively coupled to the valve member for moving the valve member relative to the valve port, the plunger being movable in the direction of the fixed suction member by the magnetization of the solenoid assembly, and a plunger spring for urging the plunger to move in the direction away from the fixed suction member; and a pressure sensitive bellows for actuating the opening or closing of the valve, the bellows being located within the inner cylindrical portion of the plunger and being expandable and contractible relative thereto in the axial direction of the solenoid assembly, the bellows being operatively coupled at one axial end thereof to the proximate end of the plunger and at the other axial end thereof to the fixed suction member.

2. The control valve according to claim 1, which further comprises:

an adjuster plug threadedly mounted on the fixed suction member; and a connecting rod coupling said other axial end of the pressure sensitive bellows to the adjuster plug, whereby the axial length of the pressure sensitive bellows is adjustable by adjustment of the position of the adjuster plug relative to the fixed suction member.

3. The control valve according to claim 1, wherein a valve-closing spring for urging the valve member in the direction to close the valve port is interposed between the valve member and an adjusting spring retainer screwed to the valve housing, the set load of the valve-closing spring being adjustable by adjustment of the spring retainer.

4. The control valve according to claim 1, wherein a valve-closing spring for urging the valve member in the direction to close the valve port is interposed between the valve member and a press-fitted spring retainer press-fittingly fixed to the valve housing, the fixed position thereof being made adjustable, whereby the set load of the valve-closing spring is adjustable by adjustment of the position of the press-fitted spring retainer relative to the valve housing.

5. The control valve according to claim 1, wherein said valve member is constituted by a spool valve.

6. The control valve according to claim 1, wherein said valve member is constituted by a ball valve.

7. The control valve according to claim 1, further comprising a plunger tube having a first axial end fixedly attached to the valve housing and a second axial end spaced from the valve housing, the plunger being slidable within the plunger tube in the axial direction thereof, the fixed suction member being coaxially fixed to the second axial end of the plunger tube, and the cylindrical solenoid assembly being removably mounted on the plunger tube and the fixed suction member in surrounding relation thereto.

* * * * *